US007163662B1

(12) United States Patent
Yamada et al.

(10) Patent No.: US 7,163,662 B1
(45) Date of Patent: Jan. 16, 2007

(54) CANNING STRUCTURE AND MANUFACTURING METHOD THEREOF

(75) Inventors: Toshio Yamada, Nagoya (JP); Toshihiko Hijikata, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 984 days.

(21) Appl. No.: 09/618,797

(22) Filed: Jul. 18, 2000

(30) Foreign Application Priority Data

Jul. 22, 1999 (JP) ..... 11-207265

(51) Int. Cl.

| | |
|---|---|
| ***B01D 53/34*** | (2006.01) |
| ***B01D 53/92*** | (2006.01) |
| ***B01D 52/94*** | (2006.01) |
| ***B21D 51/00*** | (2006.01) |
| ***B21D 51/46*** | (2006.01) |

(52) U.S. Cl. ..... 422/179; 422/168; 422/177; 422/180; 422/211; 422/221; 422/222; 29/890

(58) Field of Classification Search ..... 422/168, 422/177, 179, 180, 181, 211, 218, 221, 222; 29/890

See application file for complete search history.

(56) References Cited

U.S. PATENT DOCUMENTS

| | | | | |
|---|---|---|---|---|
| 3,959,865 | A * | 6/1976 | Close et al. | 29/890 |
| 4,142,864 | A | 3/1979 | Rosynsky et al. | 422/179 |
| 5,069,697 | A * | 12/1991 | Hamaguchi et al. | 55/523 |
| 5,114,581 | A * | 5/1992 | Goldsmith et al. | 210/650 |
| 5,725,618 | A * | 3/1998 | Shimoda et al. | 55/283 |
| 5,766,393 | A * | 6/1998 | Nishimura et al. | 156/89.22 |
| 5,782,089 | A * | 7/1998 | Machida et al. | 60/299 |
| 6,017,498 | A * | 1/2000 | Harding | 422/179 |
| 6,405,437 | B1 * | 6/2002 | Sussmilch et al. | 29/890.08 |

FOREIGN PATENT DOCUMENTS

| | | |
|---|---|---|
| DE | 195 09 029 A 1 | 12/1995 |
| EP | 0 363 681 | 4/1990 |
| EP | 0 639 700 A1 | 2/1995 |
| EP | 0 643 204 A2 | 3/1995 |
| JP | 08-061054 A | 8/1994 |
| JP | 07-077036 A | 3/1995 |

* cited by examiner

*Primary Examiner*—Alexa D. Neckel
(74) *Attorney, Agent, or Firm*—Steptoe & Johnson LLP

(57) ABSTRACT

A canning structure comprises a ceramic honeycomb structure before carrying a catalyst, fixed beforehand within a metal case by a holding material. An impermeable layer is provided on at least one edge plane in the longitudinal direction of the holding material.

Thus, the holding material does not carry expensive catalyst at the time of carrying catalyst, and accordingly chipping and cracking of the ceramic honeycomb structure can be prevented at the time of transporting, the catalyst carrying process, the canning process, and handling in each of the processes.

13 Claims, 3 Drawing Sheets

CANNING STRUCTURE AND MANUFACTURING METHOD THEREOF

BACKGROUND OF THE INVENTION

1. Field of the Invention

The present invention relates to a canning structure for a catalytic converter which is a device for purifying harmful combustion gasses exhausted from internal combustion engines and the like, and to a manufacturing method thereof.

2. Description of the Related Art

Currently, ceramic honeycomb catalytic converters are widely used as automobile exhaust gas purifying devices.

Environmental issues in recent years along with even stricter exhaust gas restrictions are requiring that catalysts be able to function immediately following starting the engine when the exhaust gas is still cool, i.e., cold starts.

Accordingly, a step being taken is to reduce the thickness of the partitions of the catalyst carrier to ½ to ⅙ of the conventional thickness, so as to lower the thermal capacity of the catalyst carrier and speed up the temperature rising of the catalyst carrier, along with improving engine performance due to reductions in pressure loss.

Normally, a ceramic honeycomb catalytic converter is manufactured as shown in FIG. 4.

First, the carrier manufacturer packages a ceramic carrier 10 (ceramic honeycomb structure) which has passed inspection, and sends it to a catalyst manufacturer.

The catalyst manufacturer unpacks this, performs processes such as causing the ceramic carrier 10 (ceramic honeycomb structure) to hold the catalyst (i.e., catalyst coating), thermal processing, inspection, etc., thereby forming a catalyst carrier 25 (ceramic honeycomb catalyst carrier), which is then packaged and sent to a canning manufacturer.

The canning manufacturer unpacks this and attaches a holding material 13 to the catalyst carrier 25 so as to fix within a metal case 11 by compressed fixing (canning), thus forming a canning catalyst carrier 30, following which joining parts such as a cone portion 17 and flange 18 and the like are welded to the canning catalyst carrier 30 as necessary, thereby completing a catalytic converter 1 (ceramic honeycomb catalytic converter).

Now, in the event that a ceramic honeycomb structure having the thickness of the partitions at around ½ to ⅙ of the conventional thickness is used as the above catalyst carrier, there has been the problem that the ceramic honeycomb structure easily cracks or chips during transporting, the catalyst carrying process, the canning process, and handling in each of the processes (e.g., packaging, unpacking, placing on or taking off of the mechanical facilities (conveyers, chucking, canning, etc.)).

In order to solve this problem, the present Inventors have proposed a new ceramic honeycomb catalytic converter manufacturing process using a canning structure (an article wherein a ceramic honeycomb structure before carrying the catalyst is fixed inside a metal case beforehand, using a holding material).

However, the above canning structure has been uneconomical, since at the time of carrying the catalyst (i.e., catalyst coating), expensive catalyst is carried by not only the ceramic honeycomb structure but also the holding material which does not take part in the catalytic reaction with the exhaust gas.

SUMMARY OF THE INVENTION

The present invention has been made in light of the present situation, and accordingly, it is an object thereof to provide a canning structure and a manufacturing method thereof, capable of preventing chipping and cracking of the ceramic honeycomb structure at the time of transporting, the catalyst carrying process, the canning process, and handling in each of the processes, without allowing the holding material to carry expensive catalyst at the time of carrying the catalyst.

That is, according to the present invention, there is provided a canning structure which comprises a ceramic honeycomb structure; said honeycomb structure having been not loaded with a catalyst, a metal case and a holding material, and said ceramic honeycomb structure being canned in said metal case and being held by said holding material thereto;

wherein an impermeable layer is provided on at least one edge plane in the longitudinal direction of the holding material.

The length of the impermeable layer here is preferably 10 mm or less, more preferably 7 mm or less, and even more preferably mm or less.

Also, the impermeable layer preferably has plane pressure properties which are approximately the same as those of the holding material, or less.

Further, at least one edge plane of the holding material having the impermeable layer is preferably on approximately the same plane as the edge plane of the ceramic honeycomb structure.

Also, with the present invention, the impermeable layer preferably comprises at least one edge plane in the longitudinal direction of the holding material to which an impermeable material has adhered.

Now, the form of the impermeable material is preferably that of a thin film, or of a rope with a circular, quadrangular, or arbitrary cross-section.

Also, the impermeable material is preferably formed of resin such as plastic, rubber, paper, cloth, or like fiber.

Further, with the present invention, the impermeable layer preferably comprises at least one edge plane in the longitudinal direction of the holding material impregnated with impermeable matter such as resin, oils and fats, etc.

Incidentally, with the present invention, the holding material is preferably a non-intumescent ceramic fiber mat.

Also, according to the present invention, there is a method for manufacturing a canning structure which comprises a ceramic honeycomb structure; said honeycomb structure having been not loaded with a catalyst, a metal case and a holding material, and said ceramic honeycomb structure being canned in said metal case and being held by said holding material thereto; which comprises forming an impermeable layer by adhering an impermeable material on at least one edge plane of the holding material in the longitudinal direction, thereby at least one edge plane of said impermeable layer of the holding material and the edge plane of the ceramic honeycomb structure are provided on approximately the same plane.

Further, according to the present invention, there is provided a method for manufacturing a canning structure comprises a ceramic honeycomb structure; said honeycomb structure having been not loaded with a catalyst, a metal case and a holding material, and said ceramic honeycomb structure being canned in said metal case and being held by said holding material thereto;

which comprises impregnating an impermeable matter so as to form an impermeable layer on at least one edge plane in the longitudinal direction of a holding material, thereby at least one edge plane of said impermeable layer of the holding material and the edge plane of the ceramic honeycomb structure are provided on approximately the same plane.

DETAILED DESCRIPTION OF THE PREFERRED EMBODIMENTS

The canning structure according to the present invention comprises a ceramic honeycomb structure before carrying a catalyst fixed beforehand within a metal case by a holding material, having an impermeable layer on at least one edge plane in the longitudinal direction of the holding material.

Thus, not only can chipping and cracking of the ceramic honeycomb structure be prevented at the time of transporting, the catalyst carrying process, the canning process, and handling in each of the processes, but also the holding material can be prevented from wastefully carrying expensive catalyst at the time of carrying the catalyst.

Next, the present invention will be described in further detail with reference to the drawings.

Figure 1A:
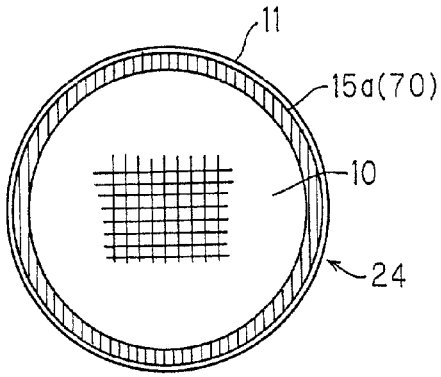
FIG. 1A is a plan view illustrating an example of the canning structure according to the present invention.
Figure 1B:
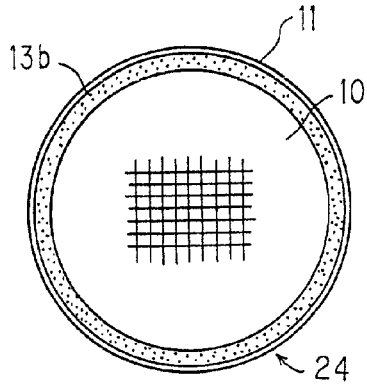
FIG. 1B is a rear view of that shown in FIG. 1A.
Figure 1C:
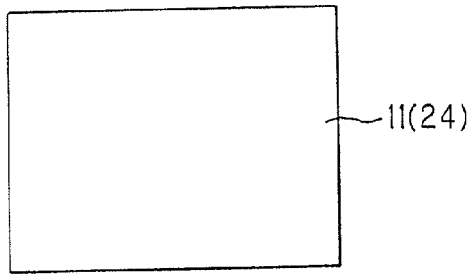
FIG. 1C is a front view of that shown in FIG. 1A.
Figure 1D:
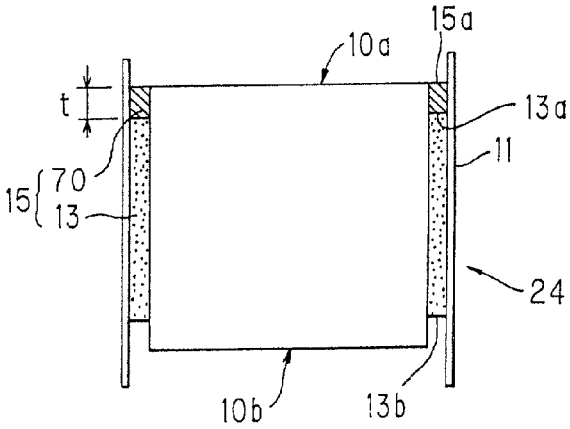
FIG. 1D is a cross-sectional view of that shown in FIG. 1A.
Figure 2A:
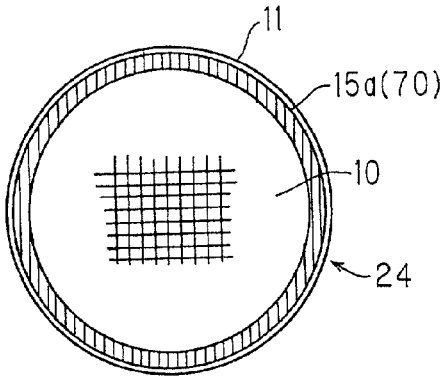
FIG. 2A is a plan view illustrating another example of the canning structure according to the present invention.
Figure 2B:
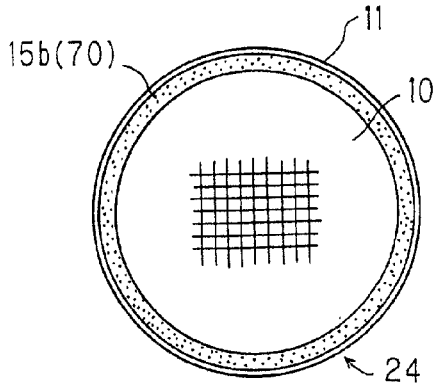
FIG. 2B is a rear view of that shown in FIG. 2A.
Figure 2C:
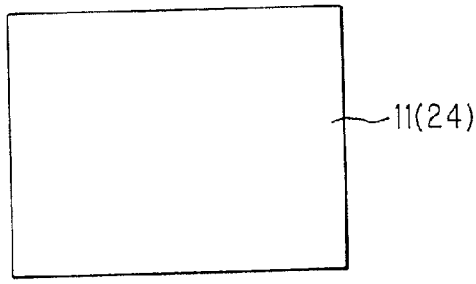
FIG. 2C is a front view of that shown in FIG. 2A.
Figure 2D:
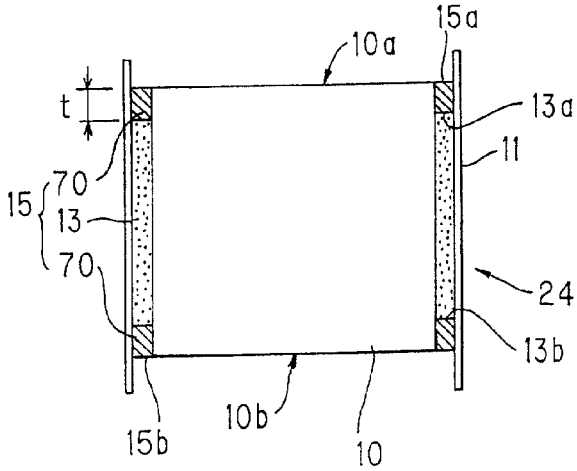
FIG. 2D is a cross-sectional view of that shown in FIG. 2A.

FIGS. 1A through 2D illustrate examples of the canning structure according to the present invention. FIGS. 1A and 2A are plan views, FIGS. 1B and 2B are rear views, FIGS. 1C and 2C are front views, and FIGS. 1D and 2D are cross-sectional views.

As shown in FIGS. 1A through 1D, the canning structure according to the present invention comprises a ceramic honeycomb structure 10 before carrying a catalyst, fixed beforehand within a metal case 11 by a holding material 13, having an impermeable layer 70 on an edge plane 13*a* in the longitudinal direction of the holding material.

At this time, the length t of the impermeable layer 70 for the canning structure 24 according to the present invention should be a minimal length, preferably 10 mm or less, more preferably 7 mm or less, and even more preferably 5 mm or less.

Also, in order to prevent damage such as cracking from occurring in the ceramic honeycomb structure due to the impermeable layer 70 at the time of canning, the plane pressure of the impermeable layer as to the ceramic honeycomb structure should be low, and accordingly, the impermeable layer 70 preferably has plane pressure properties which are approximately the same as those of the holding material 13, or less.

Further, as shown in FIG. 1, the edge plane 15*a* of the holding material at the side of the impermeable layer is preferably on approximately the same plane as the edge plane 10*a* of the ceramic honeycomb structure, and similarly, edge plane 15*b* (FIG. 2D) is preferably on approximately the same plane as edge plane 10*b*.

Accordingly, the canning structure 24 can be caused to carry the catalyst in a sure manner, thereby allowing the catalyst carrying process to be optimized.

Now, in the case of causing the canning structure 24 shown in FIG. 1 to carry the catalyst, there is the need to make sure that there is the impermeable layer 70 at the upper part of the canning structure 24, which is the side from which the catalyst slurry is poured in.

To this end, the impermeable layer 70 is more preferably provided to both longitudinal ends 13*a* and 13*b* of the holding material 13, as shown in FIGS. 2A through 2D.

Thus, the canning structure according to the present invention is capable of suppressing the catalyst slurry containing the catalyst component from flowing to the holding material in the catalyst carrying process.

Next, with the canning structure according to the present invention, the impermeable layer preferably comprises at least one edge plane in the longitudinal direction of the holding material to which an impermeable material has adhered, so as to facilitate ease of forming an impermeable layer.

Here, the form of the impermeable material used with the present invention is preferably that of a thin film, or of a rope with a circular, quadrangular, or arbitrary cross-section.

Also, the impermeable material used with the present invention is not particularly restricted so long as it has excellent impermeability and adhesion, and is preferably formed of resin such as plastic, rubber, paper, cloth, or like fiber.

Further, with the canning structure of the present invention, the impermeable layer preferably comprises at least one edge plane in the longitudinal direction of the holding material impregnated with impermeable matter such as oils and fats (e.g., grease).

Thus, the impermeable layer and the holding material can be wound onto the perimeter surface of the ceramic honeycomb structure at the same time, so the canning process can be simplified.

Here, the impermeable layer used with the present invention is preferably combustible.

This is in order to easily remove the impermeable layer which has become no longer necessary, by a thermal process (500 to 700° C.) following carrying the catalyst (catalyst coating).

Further, in addition to the above advantages, the canning structure according to the present invention is capable of protecting the ceramic honeycomb structure from external shock and vibrations, and accordingly chipping and cracking of ceramic honeycomb structures (particularly of those with thin walls (thickness of partitions; 0.10 mm or thinner)) can be prevented at the time of transporting, the catalyst carrying process, the canning process, and handling in each of the processes.

The canning structure according to the present invention is preferably of an arrangement wherein the metal case has a stuffing structure or a tourniquet structure.

This is because the plane pressure distribution at the time of canning is uniform, which allows prevention of engine exhaust gasses leaking, corrosion of the holding material due to the exhaust gasses, and rattling, damage, etc., of the ceramic honeycomb structure due to engine vibrations, thereby improving reliability.

Particularly, in the event that the metal case has a tourniquet structure, not only is the plane pressure distribution uniform, but canning can be performed at a constant plane pressure regardless of irregularities in the diameter of the ceramic honeycomb structure, which is particularly preferable for ceramic honeycomb structures with low mechanical strengths (particularly, those with thin walls).

Also, the holding material used with the present invention is preferably a non-intumescent ceramic fiber mat.

This allows the maximum plane pressure at the time of canning due to irregularities in the diameter of the ceramic honeycomb structure to be reduced, and further to prevent damage to ceramic honeycomb structures (particularly, those with thin walls), since an excessive pressure is not generated at the time of heating as with expanding mats.

Now, the non-intumescent ceramic fiber mat used with the present invention is made up of at least one selected from the following group; alumina, mullite, silicon carbide, silicon nitride, and zirconia. This non-intumescent ceramic fiber mat is formed of ceramic fibers wherein the fiber diameter is 2 μm or greater by less than 6 μm, such that application of an initial plane pressure of 2 kgf/cm$^2$ at room temperature and then raising the temperature to 1,000° C. results in generation of a plane pressure of at least 1 kgf/cm$^2$, and also has the compression properties in that there is little increase or decrease within the actual usage temperature range of the catalytic converter.

The partition thickness of the ceramic honeycomb structure used with the present invention is preferably 0.10 mm or thinner (more preferably, 0.08 mm or thinner).

This is in order to cause the catalyst to function at cold starts as well, by lowering the thermal capacity of the catalyst carrier and speeding up the temperature rising of the catalyst carrier, along with improving engine performance due to decreasing pressure loss.

Next, an example of a manufacturing processing for the ceramic honeycomb catalytic converter using the canning structure according to the present invention will be described with reference to FIG. 3.

First, the carrier manufacturer provides uses a ceramic carrier 10 (ceramic honeycomb structure) which has passed inspection, and forms a canning structure 24, which is then packaged and sent to a catalyst manufacturer.

At this time, a holding material 15 having an impermeable layer is wrapped onto the ceramic carrier 10 (ceramic honeycomb structure), which is compressed and fixed within a metal case 11 (i.e., canned), thereby forming the canning structure 24 (See FIGS. 1A through 2D).

Also, the canning structure 24 can be manufactured by wrapping a holding material 13 onto the ceramic carrier 10 (ceramic honeycomb structure), which is compressed and fixed within a metal case 11 (i.e., canned), following which an impermeable material is caused to adhere to at least one edge plane in the longitudinal direction of the holding material, so as to form an impermeable layer 70 (See FIGS. 1A through 2D).

The catalyst manufacturer unpacks this, performs the processes such as causing the canning structure 24 to carry the catalyst (i.e., catalyst coating), thermal processing, inspection, etc., thereby forming a canning catalyst carrier 30, which is then packaged and sent to a canning manufacturer.

Incidentally, the catalyst carrying process is performed by pouring a catalyst slurry in from the upper part of the canning structure 24 while suctioning the catalyst slurry out from the lower part of the canning structure 24, thereby causing the ceramic honeycomb structure to be dipped in catalyst slurry such that the canning structure 24 carries the catalyst.

At this time, the holding material provided with the impermeable layer can prevent the catalyst slurry from flowing out to the holding material. Also, the impermeable layer can be easily removed in the thermal process, if combustible.

The canning manufacturer unpacks this and welds joining parts such as a cone portion 17 and flange 18 and the like to the canning catalyst carrier 30 as necessary, thereby completing the catalytic converter (ceramic honeycomb catalytic converter 1).

As described above, this method for manufacturing ceramic honeycomb catalytic converters is capable of protecting the ceramic honeycomb structure from external shock and vibrations as compared with conventional manufacturing methods (see FIG. 4), and accordingly chipping and cracking of ceramic honeycomb structures can be markedly prevented at the time of transporting, the catalyst carrying process, the canning process, and handling in each of the processes.

Next, the present invention will be described in further detail with reference to embodiments, but it should be noted that the present invention is by no means restricted to these embodiments.

EMBODIMENT

A ceramic carrier (ceramic honeycomb structure) manufactured of cordierite, with a diameter of 106 mm, length of 114 mm, partition thickness of 0.03 mm, and 465 cells/cm$^2$, was prepared. A non-intumescent ceramic fiber mat ("MAFTEC" (product name), manufactured by MITSUBISHI CHEMICAL CORPORATION) of 1,200 g per 1 m$^2$ was further wrapped thereupon, as a holding material.

A rope-shaped impermeable member (material: polyethylene) was caused to adhere to one end 13*a* of the holding material in the longitudinal direction, thereby forming a ceramic honeycomb structure wrapped with a holding material having an impermeable layer 70 of 2 mm in length (see FIGS. 1A through 1D), which was pressed into a stainless-steel can (metal case) with an inner diameter of 114 mm, length of 124 mm, and thickness of 1.5 mm, using a tapered jig for pressing.

Figure 3:
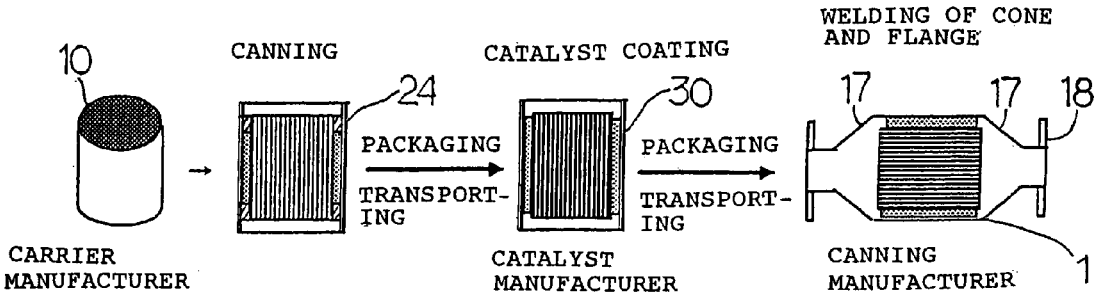
FIG. 3 is a schematic diagram illustrating an example of the manufacturing process of the ceramic honeycomb catalytic converter using the canning structure according to the present invention.

Next, twenty of such canning structures obtained with the embodiment were placed in the ceramic honeycomb catalytic converter manufacturing process shown in FIG. 3.

Consequently, the catalyst slurry was completely prevented from flowing out to the holding material in the catalyst carrying (catalyst coating) process.

Also, absolutely no cracking or chipping of the ceramic honeycomb structures was observed at any point in the above manufacturing process.

FIRST COMPARATIVE EXAMPLE

A canning structure was fabricated under the same conditions as the above embodiment, using holding material without the impermeable layer 70, and twenty of such were placed in the ceramic honeycomb catalytic converter manufacturing process shown in FIG. 3.

Consequently, the catalyst slurry flowed out to the holding material in the catalyst carrying process, such that 8% of the catalyst slurry used was held by the holding material and hence wasted.

Incidentally, absolutely no cracking or chipping of the ceramic honeycomb structures was observed at any point in the above manufacturing process.

SECOND COMPARATIVE EXAMPLE

Figure 4:
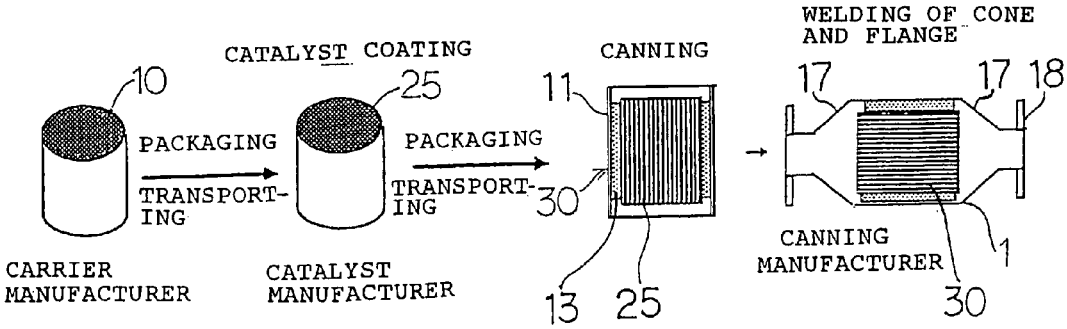
FIG.4 PRIOR ART
FIG. 4 is a schematic diagram illustrating an example of the manufacturing process of a conventional ceramic honeycomb catalytic converter.

Twenty ceramic carriers (ceramic honeycomb structures) manufactured of cordierite, with a diameter of 106 mm, length of 114 mm, partition thickness of 0.06 mm, and 140 cells/cm$^2$, were prepared, and were placed in the ceramic honeycomb catalytic converter (pressing canning) manufacturing process shown in FIG. 4.

Consequently, the rate of cracking or chipping of the ceramic honeycomb structures throughout the above manufacturing process reached 25%.

EXAMINATION OF EMBODIMENT AND COMPARATIVE EXAMPLES

The embodiment has impermeable layers on both edges in the longitudinal direction of the holding material, and thus the catalyst slurry can be prevented from flowing out to the ceramic fiber mat at the time of carrying the catalyst.

Also, in comparison with the comparative examples, the embodiment is capable of protecting the ceramic honeycomb structure from external shock and vibrations, and accordingly chipping and cracking of ceramic honeycomb structures at the time of transporting, the catalyst carrying process, the canning process, and handling in each of the processes, can be markedly reduced.

Thus, according to the canning structure and manufacturing method thereof according to the present invention, the catalyst slurry is prevented from flowing out to the holding material, and chipping and cracking of ceramic honeycomb structures can be prevented at the time of transporting, the catalyst carrying process, the canning process, and handling in each of the processes.

What is claimed is:

1. A canned ceramic honeycomb structure, comprising:

a metal case;

a ceramic honeycomb structure not loaded with a catalyst and contained within said metal case;

a holding material located between said ceramic honeycomb structure and said metal case, said holding material and said metal case having a common longitudinal direction, wherein the holding material has at least one peripheral edge defining at least one edge plane perpendicular to said longitudinal direction; and a combustible impermeable layer, which is combustible at a temperature less than about 700° C., located on said at least one edge plane, said combustible impermeable layer being provided between said ceramic honeycomb structure and said metal case.

2. A canning structure according to claim 1, wherein the length of said combustible impermeable layer is not greater than 10 mm.

3. A canning structure according to claim 1, wherein plane pressure properties of said combustible impermeable layer are not greater than those of said holding material.

4. A canning structure according to claim 1, wherein said ceramic honeycomb structure has a second edge plane, and said at least one edge plane of said holding material having said combustible impermeable layer located thereon and said second edge plane of said ceramic honeycomb structure are substantially in common.

5. A canning structure according to claim 1, wherein said combustible impermeable layer comprises a combustible impermeable material adhered to said holding material along said at least one edge plane of the holding material.

6. A canning structure according to claim 1, wherein said combustible impermeable layer is a thin film.

7. A canning structure according to claim 1, wherein said combustible impermeable layer comprises a rope having one of a circular, quadrangular, or arbitrary cross-section.

8. A canning structure according to claim 1, wherein said combustible impermeable layer comprises resin selected from the group consisting of plastic, rubber, paper, cloth, and fiber.

9. A canning structure according to claim 1, wherein said combustible impermeable layer comprises a portion located adjacent said at least one edge plane of said holding material, said portion being impregnated with combustible impermeable matter selected from the group consisting of oils and fats.

10. A canning structure according to claim 1, wherein the partition thickness of said ceramic honeycomb structure is not greater than 0.10 mm.

11. A canning structure according to claim 1, wherein said holding material comprises a non-intumescent ceramic fiber mat.

12. A canning structure according to claim 1, wherein the combustible impermeable layer is combustible at a temperature less than about 500° C.

13. A canning structure according to claim 1, wherein the combustible impermeable layer is combustible at a temperature in a range of about 500° C. to about 700° C.

* * * * *